US006648800B2

(12) United States Patent
Stearns et al.

(10) Patent No.: US 6,648,800 B2
(45) Date of Patent: Nov. 18, 2003

(54) EXERCISE APPARATUS WITH ELLIPTICAL FOOT MOTION

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 09/835,431

(22) Filed: Apr. 16, 2001

(65) Prior Publication Data

US 2002/0151411 A1 Oct. 17, 2002

(51) Int. Cl.[7] ..... A63B 69/16; A63B 22/00
(52) U.S. Cl. ..... 482/52; 482/70
(58) Field of Search ..... 482/51–53, 57, 482/70, 79–80

(56) References Cited

U.S. PATENT DOCUMENTS

| | | | | |
|---|---|---|---|---|
| 4,786,050 A | | 11/1988 | Geschwender | 272/73 |
| 5,279,529 A | | 1/1994 | Eschenbach | 48/57 |
| 5,383,829 A | | 1/1995 | Miller | 482/57 |
| 5,518,473 A | | 5/1996 | Miller | 482/51 |
| 5,529,555 A | * | 6/1996 | Rodgers, Jr. | 482/57 |
| 5,848,954 A | | 12/1998 | Stearns et al. | 482/52 |
| 5,882,281 A | | 3/1999 | Stearns et al. | 482/51 |
| 5,916,065 A | * | 6/1999 | McBride et al. | 482/57 |
| 6,024,676 A | | 2/2000 | Eschenbach | 482/51 |
| 6,080,086 A | | 6/2000 | Maresh et al. | 482/57 |
| 6,277,056 B1 | * | 8/2001 | McBride et al. | 482/57 |

* cited by examiner

*Primary Examiner*—Stephen R. Crow

(57) ABSTRACT

An exercise apparatus includes a frame; left and right first cranks rotatably mounted on the frame; left and right second cranks rotatably mounted on the frame; left and right rails rotatably interconnected between respective first cranks and respective second cranks; left and right foot supports movably mounted on respective rails; left and right rocker links pivotally mounted on the frame and operatively connected to respective foot supports; and left and right drawbar links movably interconnected between respective cranks and respective rocker links. The resulting assembly constrains the rails to move through respective circular paths relative to the frame, and constrains the foot supports to move back and forth relative to the rails.

14 Claims, 5 Drawing Sheets

EXERCISE APPARATUS WITH ELLIPTICAL FOOT MOTION

FIELD OF THE INVENTION

The present invention relates to exercise methods and apparatus and more particularly, to exercise equipment which facilitates movement of a person's feet through generally elliptical paths.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses a linkage assembly to convert a relatively simple motion, such as circular, into a relatively more complex motion, such as elliptical. For example, see U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; U.S. Pat. No. 5,882,281 to Stearns et al.; and U.S. Pat. No. 6,080,086 to Maresh et al.

SUMMARY OF THE INVENTION

Generally speaking, the present invention provides a novel linkage assembly and corresponding exercise apparatus suitable for linking circular motion to relatively more complex, generally elliptical motion. On a preferred embodiment, left and right first cranks are rotatably mounted on a rearward portion of a frame, and left and right second cranks are rotatably mounted on an opposite, forward portion of the frame. Left and right rails are rotatably interconnected between respective first cranks and respective second cranks, and left and right foot supports are movably mounted on respective rails. Left and right rocker links are pivotally mounted on the frame, and operatively connected to respective foot supports. Left and right drawbar links are movably interconnected between respective cranks and respective rocker links. The resulting assembly constrains the rails to move through respective circular paths relative to the frame, while also constraining the foot supports to move back and forth relative to respective rails. Among other things, the present invention may be considered advantageous to the extent that the foot supports remain in a single, desirable orientation during exercise activity. Additional features and/or advantages of the present invention will become apparent from the more detailed description that follows.

BRIEF DESCRIPTION OF THE DRAWINGS

With reference to the Figures of the Drawing, wherein like numerals represent like parts and assemblies throughout the several views.

DETAILED DESCRIPTION OF THE PREFERRED EMBODIMENTS

The present invention provides elliptical motion exercise machines and methods that link rotation of left and right cranks to generally elliptical motion of left and right foot supports.

The term "elliptical motion" is intended in a broad sense to describe a closed path of motion having a relatively longer, major axis and a relatively shorter, minor axis (which extends perpendicular to the major axis). In general, the present invention may be said to use displacement of the cranks to move the foot supports in a direction coincidental with the minor axis, and displacement of crank driven members to move the foot supports in a direction coincidental with the major axis. As a result, the crank diameter determines the length of the minor axis, but only indirectly affects the length of the major axis.

The embodiments disclosed herein are generally symmetrical about a vertical plane extending lengthwise through a floor-engaging base. Linkage assembly components on the left side of the machines are preferably one hundred and eighty degrees out of 5 phase relative to their opposite side counterparts. Also, to the extent that reference is made to forward or rearward portions of a machine, it is to be understood that a person can typically exercise while facing in either direction relative to the disclosed linkage assembly.

Figure 1:
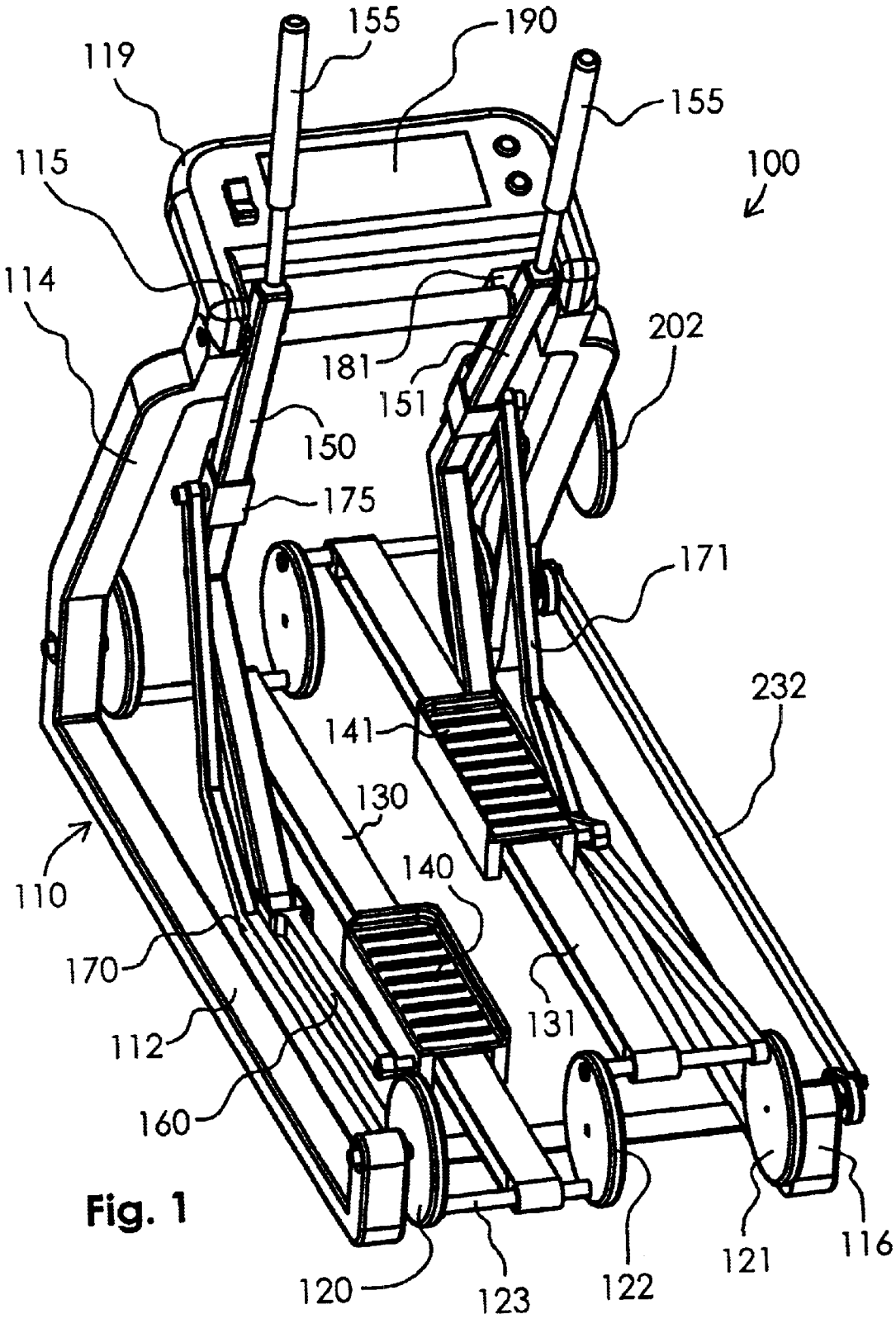
FIG. 1 is a perspective view of an exercise apparatus constructed according to the principles of the present invention.
Figure 2:
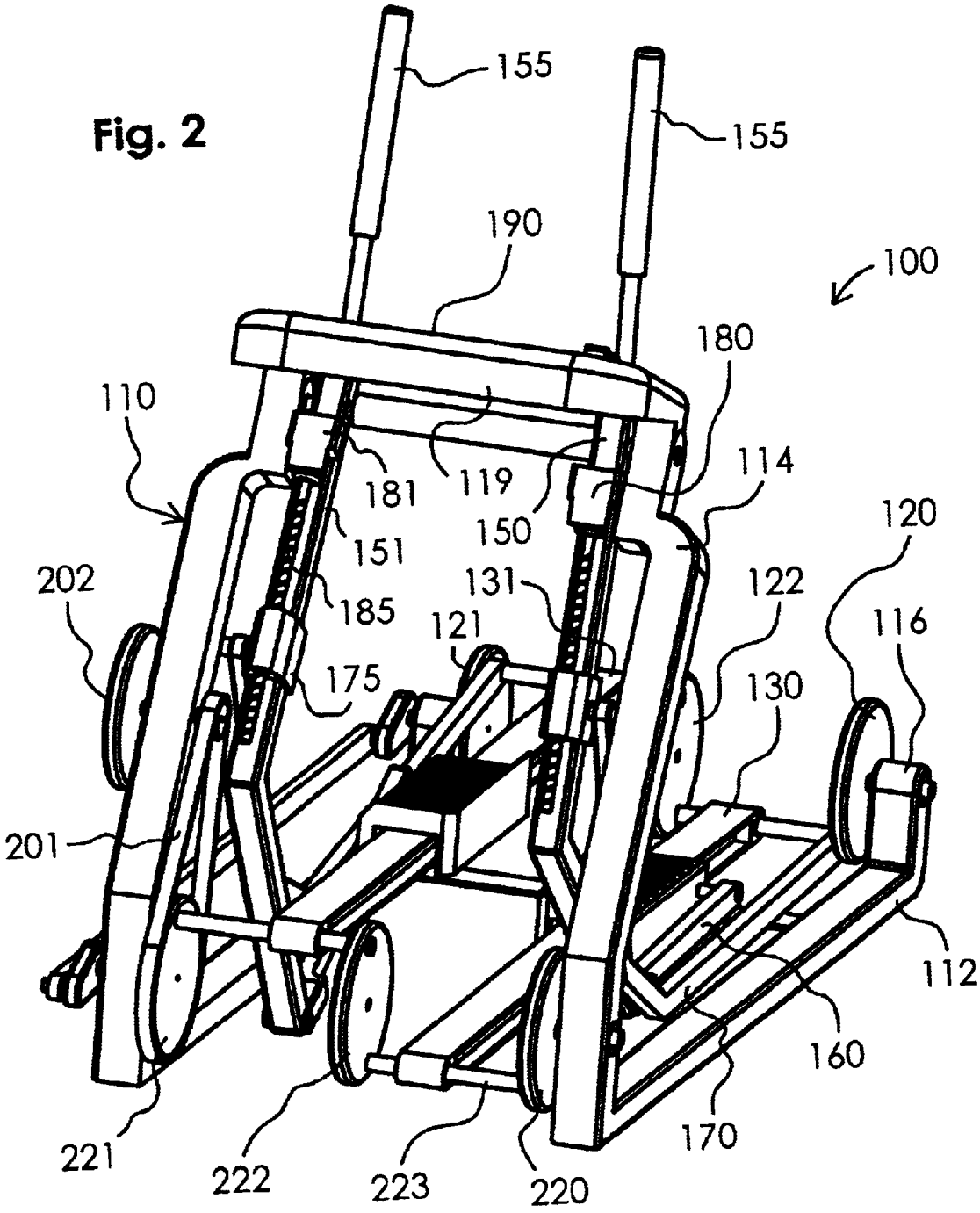
FIG. 2 is another perspective view of the exercise apparatus of FIG. 1.
Figure 3:
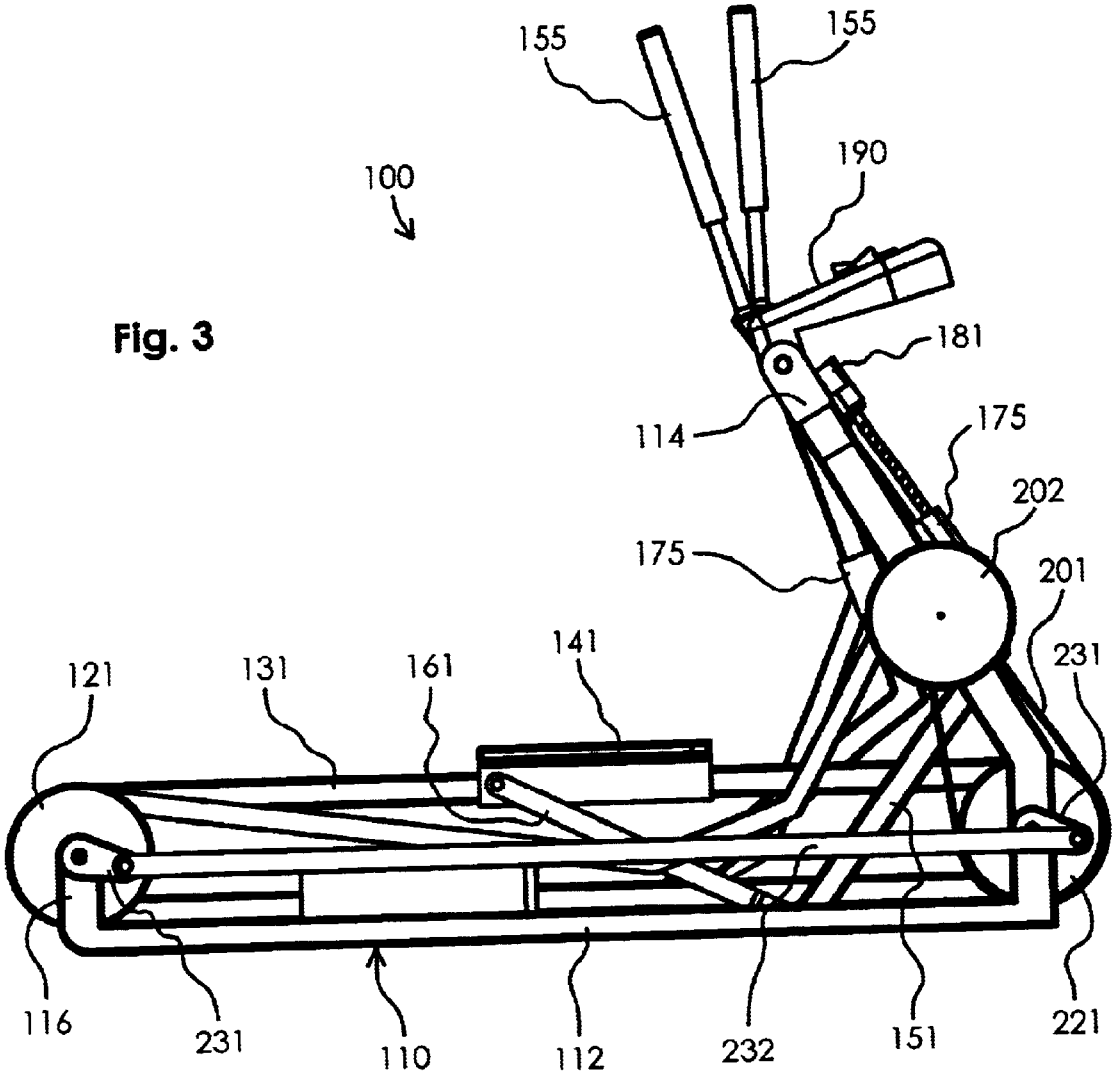
FIG. 3 is a side view of the exercise apparatus of FIG. 1.

One embodiment of the present invention is designated as 100 in FIGS. 1–3. The machine 100 generally includes a frame 110; left and right linkage assemblies movably mounted on the frame 110; and a user interface 190 mounted on the frame 110. The interface 190 may be designed to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

The frame 110 includes a floor engaging base 112; a forward stanchion 114 that extends upward from opposite sides of the base 112, proximate the front end of the frame 110; and rearward supports 116 that extend upward from respective sides of the base 112, proximate the rear end of the frame 110. The forward stanchion 114 may be described as an inverted U-shaped member having a middle portion or console portion 119 that supports the user interface 190, and generally vertical leg portions that define a gap therebetween. The console portion 119 may be configured to support additional items, including a water bottle, for example.

Each linkage assembly includes a rearward crank 120 or 121 rotatably mounted to a respective support 116 and rotatable about a common crank axis. Left and right support shafts 123 are rigidly secured to radially displaced portions of respective cranks 120 and 121, and define respective, diametrically opposed axes. A central crank disc 122 is rigidly interconnected between the inward ends of the diametrically opposed support shafts 123, thereby constraining the left and right linkage assemblies to remain one hundred and eighty degrees out of phase with one another.

A similar crank arrangement is provided at the forward end of the machine 100. In other words, each linkage assembly also includes a forward crank 220 and 221 rotatably mounted to a respective side of the stanchion 114 and rotatable about a common crank axis. Left and right support shafts 223 are rigidly secured to radially displaced portions of respective cranks 220 and 221, and define respective, diametrically opposed axes. A central crank disc 222 is rigidly interconnected between the inward ends of the diametrically opposed support shafts 223, thereby constraining the left and right linkage assemblies to remain one hundred and eighty degrees out of phase with one another.

Each linkage assembly also includes a rail 130 or 131 having a rearward end that is rotatably mounted on a respective rearward support shaft 123, and an opposite, forward end that is rotatably mounted on a respective forward support shaft 223. As a result of this arrangement, the rails 130 and 131 are constrained to move through respective circular paths in response to rotation of the cranks 120 and 121 and 220 and 221.

Each linkage assembly also includes a foot support or skate 140 or 141 movably mounted on a respective rail 130 or 131. Rollers or bearings are preferably disposed between the foot supports 140 and 141 and respective rails 130 and 131 to facilitate a smooth gliding interface therebetween. In any event, the foot supports 140 and 141 are constrained to move vertically together with respective rails 130 and 131, but remain free to move horizontally relative to respective rails 130 and 131. In this regard, the "skate" arrangement effectively "decouples" the foot supports 140 and 141 from the horizontal displacement of the cranks 120 and 121 and 220 and 221.

Each linkage assembly also includes a rocker link 150 or 151 pivotally mounted on a respective side of the stanchion 114 and pivotal about a common pivot axis. On the embodiment 100, each rocker link 150 and 151 is pivotally connected to a common support shaft 115 that spans the stanchion 114. Each rocker link 150 and 151 has an upper distal portion 155 that is sized and configured for grasping. Each rocker link 150 and 151 has an opposite, generally L-shaped lower portion that extends downward and then rearward. Forward ends of respective intermediate links 160 are rotatably connected to lower distal ends of respective rocker links 150 and 151, and opposite, rearward ends of respective intermediate links 160 are rotatably connected to respective foot supports 140 and 141.

Each linkage assembly also includes a drawbar link 170 or 171 having a rear end pivotally coupled to a respective crank 120 or 121 (or rail), and a forward end pivotally coupled to a respective rocker link 150 or 151. Each drawbar link 170 or 171 links rotation of a respective crank 120 or 121 to reciprocal pivoting of a respective rocker link 150 or 151. The "pivot arm" or radius associated with the drawbar links 170 and 171 is shorter than the "pivot arm" or radius associated with the intermediate links 160 and 161, and thus, the foot supports 140 and 141 are constrained to move fore and aft to a greater extent than the drawbar links 170 and 171. This "amplification effect" may be adjusted by securing the drawbar links 170 and 171 in alternative locations along respective rocker links 150 and 151.

On the machine 100, each drawbar link 170 or 171 is pivotally connected to a respective bracket 175, which in turn, is movably mounted on a respective rocker link 150 or 151. Low friction material is preferably disposed between the brackets 175 and respective rocker links 150 and 151 to facilitate a smooth gliding interface therebetween. Actuators or stepper motors 180 and 181 are mounted on respective rocker links 150 and 151, and are connected to respective brackets 175 via respective lead screws 185. The actuators 180 and 181 may be connected to the interface 190 (or another suitable controller) in various known ways, including wires routed through respective rocker links 150 and 151 and then through the support shaft 115. The lead screws 185 are threaded through respective brackets 175, and the actuators 180 and 181 are operable to rotate respective lead screws 185 and thereby move respective brackets 175 along respective rocker links 150 and 151. As the brackets 175 are moved closer to the pivot axis of the rocker links 150 and 151, the amplification effect is increased, and the foot supports 140 and 141 are constrained to move through relatively longer paths.

The machine 100 is shown with a bar 232 rotatably interconnected between forward and rearward crank arms 231, which are keyed to respective cranks 121 and 221. The bar 232 is ninety degrees out of phase with the rails 130 and 131, and it cooperates with the rails 130 and 131 to maintain reliable synchronization between the rearward cranks 120 and 121 and the forward cranks 220 and 221.

The machine 100 is also shown with a flywheel 202 rotatably mounted on the right side of the stanchion 114. As shown in FIG. 2, a belt 201 is looped about the crank 221 and a relatively smaller diameter pulley, which in turn, is keyed to the flywheel 202. As a result, the flywheel 202 is constrained to rotate at a relatively faster speed than the crank 221. The flywheel 202 adds inertia to the linkage assemblies, and various types of known devices (such as a drag strap or an eddy current brake) may be operatively connected to the flywheel 202 to provide adjustable resistance, as well.

An advantage of the machine 100 is that essentially the entire length of the machine 100 is available for accommodating movement of a person's feet through desirable elliptical paths. As a result, both the footprint or planform of the machine 100 and the space needed for its operation are relatively small in comparison to the available stride length. The machine 100 may also be considered advantageous to the extent that the stride length may be adjusted during exercise activity, and/or the stride length is not limited by the diameter or stroke of any of the cranks.

Another desirable feature of the machine 100 is that the foot platforms 140 and 141 are positioned in close proximity to one another, thereby accommodating foot motion which may be considered a better approximation of real life activity. In this regard, the opposite side cranks 120 and 121 and 220 and 221 and the central support cranks 122 and 222 eliminate the need for a frame supported bearing assembly between the foot platforms 140 and 141. In the absence of a central bearing assembly, one or more shields or guards may be disposed between the opposite side foot supports 140 and 141 in order to eliminate pinch points.

Figure 4:
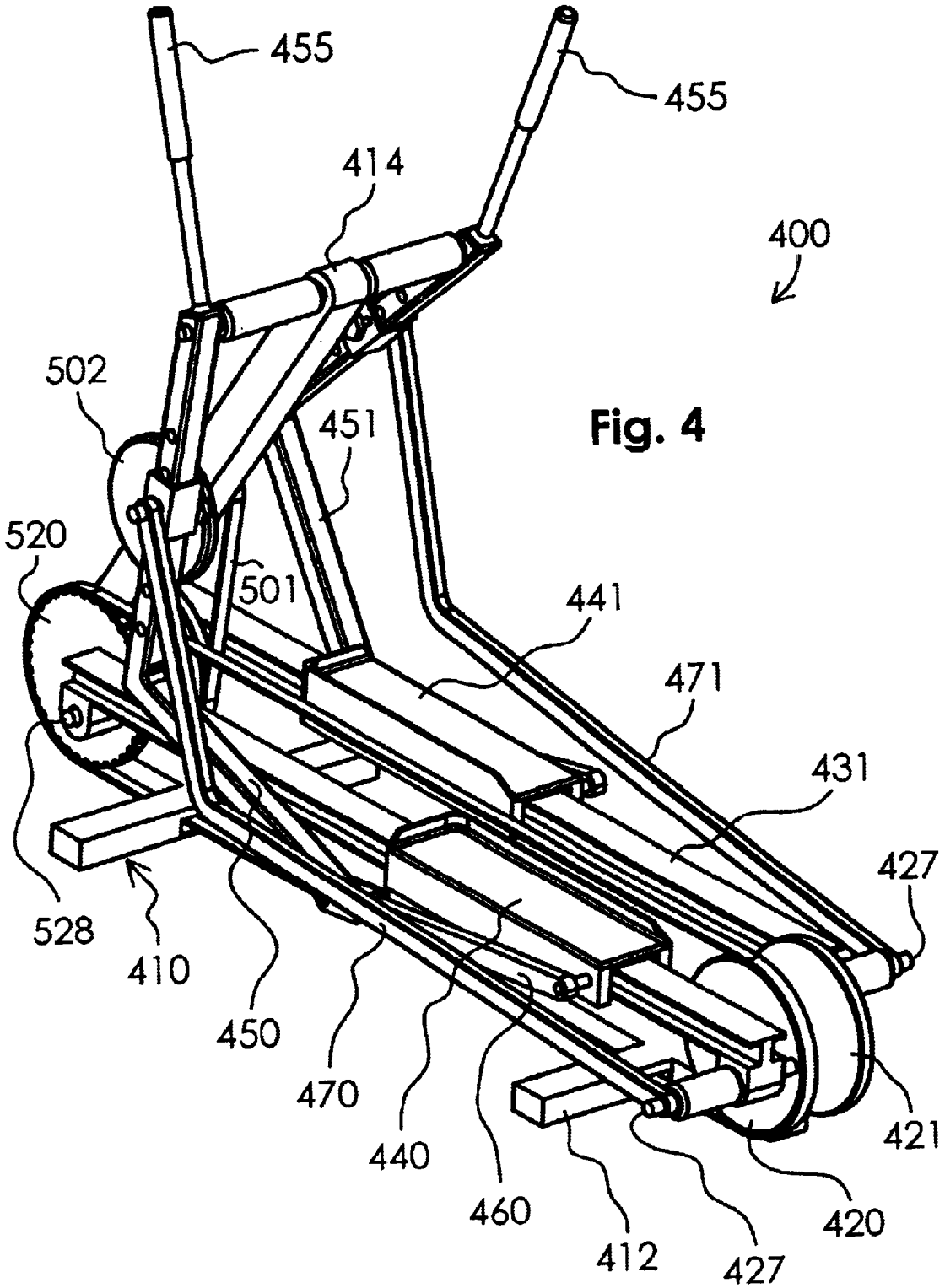
FIG. 4 is a perspective view of another exercise apparatus constructed according to the principles of the present invention.
Figure 5:
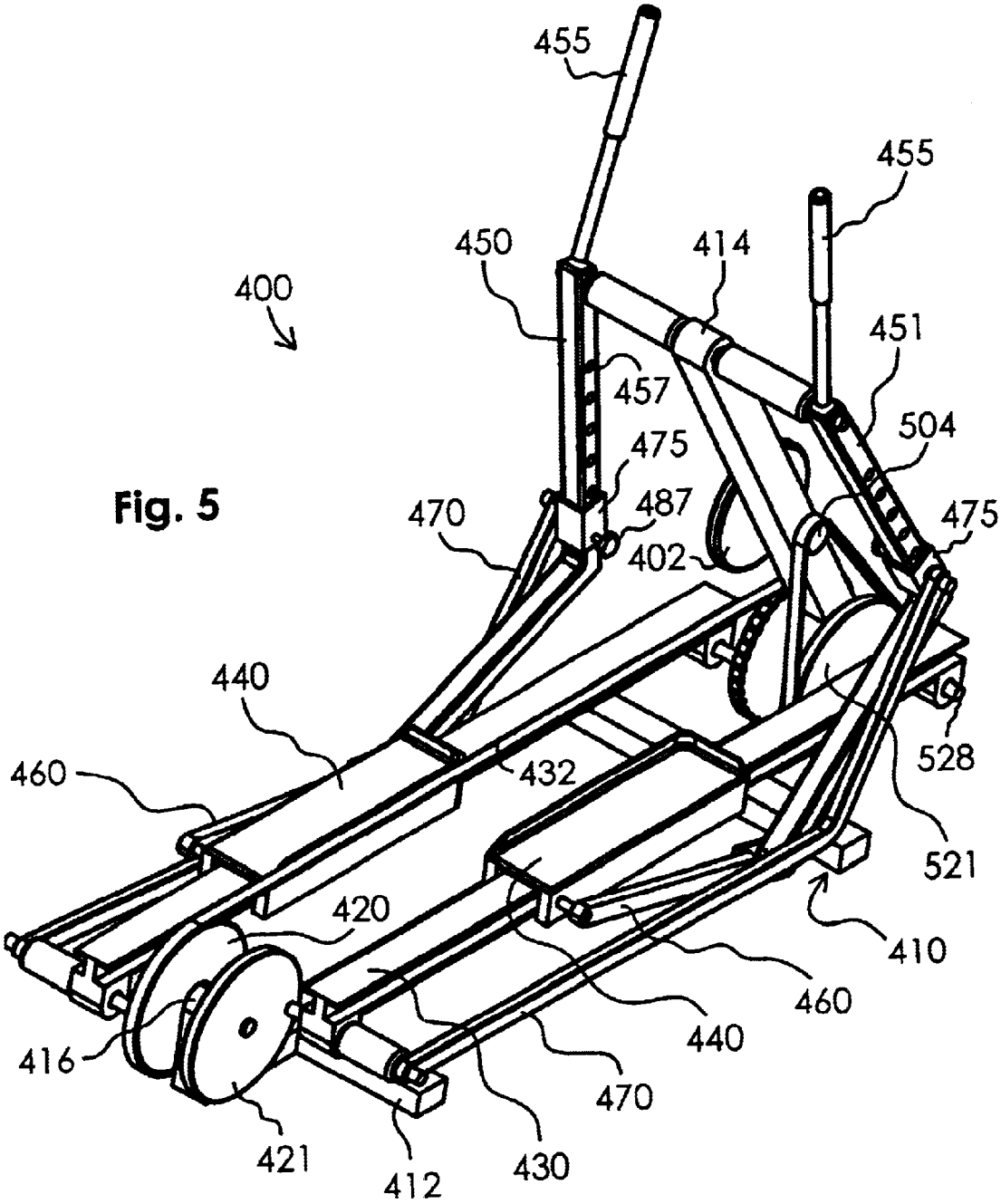
FIG. 5 is another perspective view of the exercise apparatus of FIG. 4.

Another embodiment of the present invention is designated as 400 in FIGS. 4–5. The exercise machine 400 includes a frame 410 having a floor engaging base 412; a forward stanchion 414 that extends upward from the base 412; and a rearward stanchion 416 that extends upward from the base 412.

Rearward cranks 420 and 421 are rotatably mounted on the rearward stanchion 416. The cranks 420 and 421 are keyed to a common shaft and rotatable about a common axis. Left and right support shafts 427 are rigidly secured to radially displaced portions of respective cranks 420 and 421, thereby defining respective, diametrically opposed axes that rotate about the rearward crank axis. Similarly, forward cranks 520 and 521 are rotatably mounted on the forward stanchion 414, keyed to a common shaft, and rotatable about a common crank axis. Left and right support shafts 528 are rigidly secured to radially displaced portions of respective cranks 520 and 521, and define respective, diametrically opposed axes that rotate about the forward crank axis.

A left rail 430 has a rearward end that is rotatably mounted on the left rearward support shaft 427, and an opposite, forward end that is rotatably mounted on the left forward support shaft 528. Similarly, a right rail 431 has a rearward end that is rotatably mounted on the right rearward support shaft 427, and an opposite, forward end that is rotatably mounted on the right forward support shaft 528. As a result, the rails 430 and 431 are constrained to move through circular paths in response to rotation of the cranks 420 and 421 and 520 and 521, and to remain one hundred eighty degrees out of phase relative to one another.

A left foot support or skate 440 is movably mounted on the left rail 430, and a right foot support or skate 441 is movably mounted on the right rail 431. Rollers or bearings are preferably disposed between the foot supports 440 and 441 and respective rails 430 and 431 to facilitate a smooth gliding interface therebetween. In any event, the foot supports 440 and 441 are constrained to move vertically together with respective rails 430 and 431, but remain free to move horizontally relative to respective rails 430 and 431. In this regard, the "skate" arrangement effectively "decouples" the foot supports 440 and 441 from the horizontal displacement of respective rails 430 and 431 and the associated cranks 420 and 421 and 520 and 521.

Rocker links 450 and 451 are pivotally mounted on opposite sides of the forward stanchion 414 and pivotal about a common pivot axis. Each rocker link 450 and 451 has an upper distal portion 455 that is sized and configured for grasping. Each rocker link 450 and 451 has an opposite, generally L-shaped lower portion that extends downward and then rearward. Forward ends of respective intermediate links 460 are rotatably connected to lower distal ends of respective rocker links 450 and 451, and opposite, rearward ends of respective intermediate links 460 are rotatably connected to respective foot supports 440 and 441.

A left drawbar link 470 has a rear end pivotally coupled to the left rearward support shaft 427, and a forward end pivotally coupled to an intermediate portion of the left rocker link 450. Similarly, a right drawbar link 471 has a rear end pivotally coupled to the right rearward support shaft 427, and a forward end pivotally coupled to an intermediate portion of the right rocker link 451. Each drawbar link 470 or 471 links rotation of a respective crank 420 or 421 to reciprocal pivoting of a respective rocker link 450 or 451. The "pivot arm" or radius associated with the drawbar links 470 and 471 is shorter than the "pivot arm" or radius associated with the intermediate links 460 and 461, and thus, the foot supports 440 and 441 are constrained to move fore and aft to a greater extent than the drawbar links 470 and 471. The extent of this "amplification effect" may be adjusted by securing the drawbar links 470 and 471 in alternative locations along respective rocker links 450 and 451.

On the machine 400, each drawbar link 470 or 471 is pivotally connected to a respective bracket 475, which in turn, is movably mounted on a respective rocker link 450 or 451. Low friction material is preferably disposed between the brackets 475 and respective rocker links 450 and 451 to provide a smooth interface therebetween. Pins 487 are mounted on respective brackets 475, and are connected to respective rocker links 450 and 451 via respective holes 457. Spring latching arrangements or other known means may be provided to bias the pins 487 to remain in selected holes 457. As the brackets 475 are moved closer to the pivot axis of the rocker links 450 and 451, the amplification effect is increased, and the foot supports 440 and 441 are constrained to move through relatively longer paths.

The machine 400 is shown with a timing belt 432 looped about the left cranks 420 and 520. The timing belt 432 ensures reliable synchronization between the rearward cranks 420 and 421 and the forward cranks 520 and 521. The machine 400 is also shown with a flywheel 502 and a relatively small diameter pulley 504 rotatably mounted on opposite sides of the forward stanchion 414. The flywheel 502 and the pulley 504 are keyed to a common shaft, and a belt 501 is looped about the pulley 504 and the relatively larger diameter crank 521. As a result, the flywheel 502 is constrained to rotate at a relatively faster speed than the crank 521. The flywheel 502 adds inertia to the linkage assemblies, and various types of known devices (such as a drag strap or an eddy current brake) may be operatively connected to the flywheel 502 to provide adjustable resistance, as well.

The present invention is disclosed with reference to particular embodiments and specific applications, and this disclosure will enable persons skilled in the art to derive additional embodiments, improvements, and/or applications. Therefore, the scope of the present invention should be limited only to the extent of the following claims.

What is claimed is:

1. An exercise apparatus, comprising:

a frame having a base that is configured to rest upon a floor surface;

a left first crank and a right first crank, wherein each said first crank is rotatably mounted on the frame;

a left second crank and a right second crank, wherein each said second crank is rotatably mounted on the frame;

a left rail and a right rail, wherein each said rail is rotatably interconnected between a respective first crank and a respective second crank;

a left foot support and a right foot support, wherein each said foot support is movably mounted on a respective rail;

a left rocker link and a right rocker link, wherein each said rocker link is pivotally mounted on the frame and operatively connected to a respective foot support;

a left drawbar link rotatably interconnected between the left rocker link and one of the left cranks, wherein said left drawbar link and said left rocker link cooperate to link rotation of the left cranks to movement of the left foot support along the left rail; and a right drawbar link rotatably interconnected between the right rocker link and one of the right cranks, wherein said right drawbar link and said right rocker link cooperate to link rotation of the right cranks to movement of the right foot support along the right rail.

2. The exercise apparatus of claim 1, wherein a synchronization bar is rotatably interconnected between one said first crank and a respective second crank.

3. The exercise apparatus of claim 1, wherein an upper distal end of each said rocker link is sized and configured for grasping.

4. The exercise apparatus of claim 1, wherein each said foot support is a skate that is rollably mounted on a respective rail.

5. The exercise apparatus of claim 4, wherein a left link is rotatably interconnected between the left rocker link and the left foot support, and a right link is rotatably interconnected between the right rocker link and the right foot support.

6. The exercise apparatus of claim 1, wherein each said drawbar link cooperates with a respective rocker link to define a respective rotational axis that is selectively movable along the respective rocker link.

7. The exercise apparatus of claim 6, further comprising a left actuator and a right actuator, wherein each said actuator is mounted on a respective rocker link and operable to move a respective rotational axis in response to a control signal.

8. The exercise apparatus of claim 1, wherein each said first crank is disposed between left and right first bearing assemblies, and each said second crank is disposed between left and right second bearing assemblies.

9. The exercise apparatus of claim 1, further comprising a synchronizing means, interconnected between one said first crank and a respective second crank, for synchronizing rotation of said cranks.

10. The exercise apparatus of claim 1, further comprising left and right adjusting means, interconnected between respective rocker links and respective drawbar links, for adjusting associated points of interconnection along respective rocker links.

11. The exercise apparatus of claim 1, wherein all points on each said rail are constrained to travel through respective circular paths during rotation of said cranks, and all points on each said foot support are constrained to travel through respective elliptical paths during rotation of said cranks.

12. The exercise apparatus of claim 11, wherein each of said elliptical paths has a respective minor axis that is equal to a diameter defined by the circular paths, and a respective major axis that is relatively longer.

13. The exercise apparatus of claim 12, further comprising left and right adjusting means, interconnected between respective rocker links and respective drawbar links, for adjusting each said major axis by selectively moving points of connection between respective rocker links and respective drawbar links along respective rocker links.

14. The exercise apparatus of claim 13, wherein each said adjusting means includes a bracket that is slidably mounted on a respective rocker link and rotatably connected to a respective drawbar link.

* * * * *